US009267355B2

(12) United States Patent
Lumbye

(10) Patent No.: US 9,267,355 B2
(45) **Date of Patent: *Feb. 23, 2016**

(54) COMPLETION ASSEMBLY FOR STIMULATING, SEGMENTING AND CONTROLLING ERD WELLS

(75) Inventor: Peter Lumbye, Màløv (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/379,870

(22) PCT Filed: Jun. 22, 2010

(86) PCT No.: PCT/EP2010/058793

§ 371 (c)(1),
(2), (4) Date: Mar. 13, 2012

(87) PCT Pub. No.: WO2010/149644

PCT Pub. Date: Dec. 29, 2010

(65) Prior Publication Data

US 2012/0160520 A1 Jun. 28, 2012

Related U.S. Application Data

(60) Provisional application No. 61/219,193, filed on Jun. 22, 2009.

(30) Foreign Application Priority Data

Jun. 22, 2009 (DK) ..... 2009 00764

(51) Int. Cl.
*E21B 33/12* (2006.01)
*E21B 34/08* (2006.01)
*E21B 34/10* (2006.01)

(52) U.S. Cl.
CPC ..... *E21B 34/085* (2013.01); *E21B 34/102* (2013.01)

(58) Field of Classification Search
CPC ..... E21B 34/102; E21B 34/085
USPC ..... 166/306, 317, 191, 386, 307, 373, 166/334.1, 141; 137/67, 68.11, 78.3
See application file for complete search history.

(56) References Cited

U.S. PATENT DOCUMENTS 2,832,415 A * 4/1958 Reistle, Jr. ..... 166/292
2,897,897 A 8/1959 Breukelman (Continued)

FOREIGN PATENT DOCUMENTS

| | | |
|---|---|---|
| EP | 1184537 A1 | 3/2002 |
| GB | 2394736 | 5/2004 |
| RU | 48577 U1 | 10/2005 |
| WO | WO 01/65060 | 9/2001 |
| WO | 2004099560 | 11/2004 |
| WO | WO2008139132 | 11/2008 |

OTHER PUBLICATIONS

Search Report for PA 2009 00764, Feb. 1, 2010.

(Continued)

*Primary Examiner* — Jennifer H Gay
*Assistant Examiner* — George Gray
(74) *Attorney, Agent, or Firm* — Brinks Gilson & Lione

(57) ABSTRACT

An assembly to be run within a well tubular includes a first fluid controller in a first section of the tubular and a second fluid controller in a second section of the well tubular. The assembly includes a set of packers for sealing of the space between the well tubular and a well bore surface of the well. The set-of packers are positioned such that a part of the well tubular having both the first fluid controller and the second fluid controller is located between the set of packers. The first fluid controller is configured to selectively block fluid flow from the interior of the well tubular to the space between the well tubular and the well bore surface. The second fluid controller is configured to selectively block fluid flow.

19 Claims, 2 Drawing Sheets

(56) References Cited

U.S. PATENT DOCUMENTS

| | | | | |
|---|---|---|---|---|
| 3,252,904 | A * | 5/1966 | Carpenter | 166/283 |
| 3,586,018 | A * | 6/1971 | Bogardh et al. | 137/67 |
| 4,949,788 | A | 8/1990 | Szarka | |
| 5,441,929 | A * | 8/1995 | Walker | 507/260 |
| 6,481,500 | B1 | 11/2002 | Burd | |
| 6,915,848 | B2 | 7/2005 | Thomeer et al. | |
| 7,066,265 | B2 * | 6/2006 | Surjaatmadja | 166/308.1 |
| 7,604,055 | B2 | 10/2009 | Richard et al. | |
| 7,828,067 | B2 * | 11/2010 | Scott et al. | 166/386 |
| 7,967,071 | B2 | 6/2011 | Brown | |
| 2001/0018977 | A1 * | 9/2001 | Kilgore | 166/387 |
| 2002/0153142 | A1 | 10/2002 | Eslinger | |
| 2003/0188871 | A1 | 10/2003 | Dusterhoft | |
| 2005/0061508 | A1 | 3/2005 | Surjaatmadja | |
| 2005/0103495 | A1 | 5/2005 | Corbett | |
| 2006/0042795 | A1 | 3/2006 | Richards | |
| 2008/0283238 | A1 | 11/2008 | Richards | |
| 2008/0283252 | A1 | 11/2008 | Guignard | |
| 2009/0090502 | A1 | 4/2009 | Lumbye | |
| 2009/0101352 | A1 * | 4/2009 | Coronado et al. | 166/373 |

OTHER PUBLICATIONS

International-Type Search Report for DK 200900764, Feb. 18, 2010.

International Search Report for PCT/EP2010/058793, Dec. 29, 2010.

Written Opinion of the International Search Authority for PCT/EP2010/058793, Dec. 22, 2011.

International Preliminary Report on Patentability for PCT/EP2010/058793, Mar. 1, 2012.

Search Report for PA 2009 00765, dated Feb. 1, 2010.

International-Type Search Report for DK 200900765, dated Feb. 18, 2010.

International Search Report for PCT/EP2010/058792, dated Aug. 26, 2010.

Written Opinion of the International Search Authority for PCT/EP2010/058792, dated Aug. 26, 2010.

International Preliminary Patentability Report for PCT/EP2010/058792, dated Jan. 4, 2012.

Office Action for Kazakhstan Application No. 2012/1502.1, dated Jan. 31, 2014.

* cited by examiner

COMPLETION ASSEMBLY FOR STIMULATING, SEGMENTING AND CONTROLLING ERD WELLS

RELATED APPLICATIONS

This application claims the benefit under 35 U.S.C. §371 of International Patent Application No. PCT/EP2010/058793, having an international filing date of Jun. 22, 2010, which claims priority to Danish Patent Application No. PA 2009 00764, filed Jun. 22, 2009, and U.S. Provisional Application No. 61/219,193, filed Jun. 22, 2009, the contents of all of which are incorporated herein by reference in their entirety.

TECHNICAL FIELD

The present invention relates to an assembly to be run with a well tubular having openings provided in the wall and for being arranged in a well bore and thereby forming a space between said tubing and the well bore surface, said assembly comprising; first fluid control means being provided in one opening in said well tubular; second fluid control means being provided in another opening in said well tubular and; a set of packers for sealing off the space between said tubing and the well bore surface, said set of packers being positioned such that a part of the tubular having both first and second fluid control means is located between the set of packers. Thereby the packers divide the spacing between the well bore and the tubing into separate sections.

The present description includes both a drilled well intended for injection of water into the formation with a view to displacing oil or gas in a direction towards a drilled production well or it may be a drilled production well intended for production of oil or gas.

RELATED PRIOR ART

Before the injection of water into the formation can be initiated, it is necessary to stimulate a well bore by pumping down acid that decomposes the compacted layer of drilling mud on the wall of the well bore and a part of the formation. The acid is conveyed into the well bore by means of a supply pipe with a nozzle head that is, while acid is being pumped down, withdrawn slowly from the bottom of the well bore. The described process is labour-intensive, costly and delays the time of onset of production.

OBJECT OF THE INVENTION

The invention aims to remedy the problems and limitations that are associated with conventional techniques for stimulating a drilled well and to provide a new assembly, wherein the invention enables subsequent control of the stimulated well. The system will allow for stimulation and zonal isolation (or segmenting the reservoir), in a quick and efficient manner.

SUMMARY OF THE INVENTION

The object of the invention is obtained by an assembly where the first fluid control means is adapted such that it is capable of blocking fluid flow from the interior of said well tubular to said space between said tubing and the well bore surface and that the second fluid control means is adapted such that it is capable of blocking fluid flow from said space between said tubing and the well bore surface to the interior of said well tubular, said second fluid control means comprise a valve equipped with a self-closing mechanism which is capable of completely closing off the valves, said self-closing mechanism being adapted such that acid stimulation may take place through the second fluid control means while in their open state.

By using valves equipped with a (self-closing) mechanism capable of completely closing off the valves, e.g. after a certain time delay, it is accomplished that "injector wells" can be stimulated via the second fluid control means with acid prior to being used. When the second fluid control means are subsequently closed, the subsequent injection of water will take place via the first fluid control means in the individual sections of the well (between two packers) and thereby an increased control of that type of well is also accomplished since the individual sections can thereby be closed down by means of the first fluid control means.

These openings equipped with second fluid control means can e.g. be distributed as described in European patent application NO EP1184537A.

In one embodiment of the invention the first fluid control means comprises a sliding sleeve door (ssd) arranged on the tubular. The sliding sleeve door comprises an aperture in the tubular through which the oil or gas will enter the tubing. The sliding sleeve door can be closed or opened during operation of the well. Sliding sleeve doors are well known to the person skilled in the art and there functionality will therefore not be described in greater details.

In another embodiment screens for the removing of sand particles from the fluid of oil and gas are arranged on the outside of the sliding sleeve door. Such a screen can be manufactured from the material Boron Carbide, which offers the advantage that it can only be eroded by pure diamonds. Furthermore, Boron Carbide ceramic material has a good resistance against acids, such that cleaning of the filter can be done by an acid treatment.

In another embodiment the second fluid control means comprise a check valve, which will allow fluid to flow from the interior of said well tubular to said space between the tubular and the well bore. By use of check valve the stimulation treatment can flow out and into the formation through the non-return valves, while production flow can enter the tubular through the first fluid control means.

Other embodiment of the invention are recited in the independent claims

Methods of use of the assembly are recited in claims 10-11.

The invention will now be described in further detail with reference to the preferred embodiments shown in the drawings.

Figure 1:
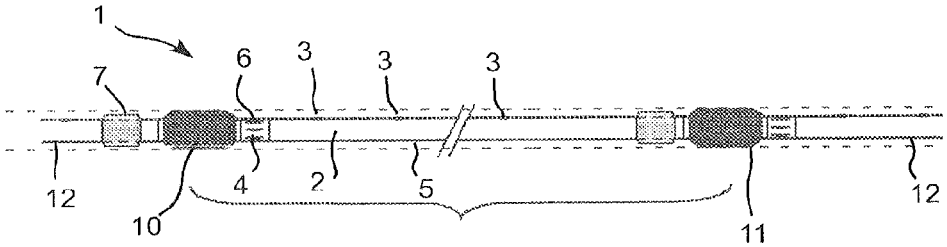
FIG. 1 shows an assembly according to an embodiment of the invention.

FIG. 1 shows a tubular 12 of the type which is usually used in the context of water injection or production of oil or gas, is arranged in a well. In the shown embodiment means are arranged for establishing a number of external packers 10, 11 to the effect that it is possible to inject water to selected areas, between the packers, of the oil reservoir. The tubing has openings 3, 4 provided in the wall. Between the tubing and the well bore surface is formed a space, tubular space or annulus 5.

In conventional tubing openings 3 are regular holes which allows fluid flow to run both from the interior of the tubing 12 and to annular space 5 and from the annular space to the interior of the tubing. The reason behind having these openings is to facilitate the stimulation of the wellbore. The openings 3 can have a location that comply with particular, predefined specifications, as e.g. described in patent application NO EP 1184537A In the assembly according to the invention these openings are provided with fluid control means (not shown in FIG. 1) which in the following is called "second fluid control means". These second fluid control means are according to invention capable of blocking the fluid flow in both directions. In the shown embodiment is the assembly also provided with another opening 6 which is equipped with "first fluid control means" 4. The first fluid control means is, in the shown embodiment, a device called a "sliding sleeve" which is a well known piece of equipment in the E&P industry. Such a device normally comprises a "standard" inner sleeve which allows for opening or closing (or choking) of the device.

Opening or closing of a "sliding sleeve" is normally achieved by use of known intervention tools run on a wireline or a coiled tubing. However the opening and closing of the opening 6 can be achieved in many other ways known to the person skilled in the art and the activation of the first fluid control means can even be made such that it is controllable from the surface.

The packers 10, 11 are positioned such that a part the tubular having both first 4 and second fluid control means 3 is located between the set of packers 10, 11. Normally, the first fluid control means is adapted such that it is capable of selectively opening or blocking fluid flow from the interior of said well tubular to said space 5 between the formation and the well tubular 2 and the second fluid control means is adapted such that it is capable of either allowing or blocking fluid flow both from said space to the interior of said well tubular and from the interior of said well tubular to said space 5 between the formation and the well tubular 2. In one embodiment of the invention is the second fluid control means adapted such that it is capable to first allow fluid flow in both direction and thereafter to close off fluid direction in both directions. This can e.g. be accomplished by use of valves equipped with a self-closing mechanism which keeps the valves open until it is triggered to close by a time delay mechanism.

By using valves equipped with a (e.g. self-closing) mechanism which is capable of completely closing off the valves, it is accomplished that "injector wells" can be stimulated via the second fluid control means with acid prior to being used. When the second fluid control means are subsequently closed, the subsequent injection of water will take place via the first fluid control means in the individual sections of the well (between two packers) and thereby an increased control of that type of well is also accomplished since the individual sections can thereby be closed down by means of the first fluid control means.

By establishing of several independent assemblies having both first and second fluid control means in a well as described above it is thus possible to stimulate and open up or close off production from selected parts of the well. Opening and/or closing off such a part is normally done on order to isolate e.g. a water producing part of the well to ingress of water, or to delimit a part of the well.

As described above the second fluid control means may be equipped with a closure mechanism that does not close until a given period of time has elapsed. However, the second fluid control means may also be equipped with a closure mechanism that does not close until the closure mechanism is activated by some kind of activation means, as e.g described below. Thereby it is obtained that (when the well is a recently established one) acid stimulation may take place through the second fluid control means while in their open state.

In one embodiment of the invention the assembly comprises an inflatable packer section or a "mechanical" packer that does not rely on inflation with fluids. Such packers are known in the industry and comprises e.g. packers that needs to be triggered with a timer and then it sets by squeezing a steel enforced rubber membrane that then creates the seal.

The inflatable packer section might be equipped with one or more packers which can be inflated by fluid. Such inflatable packers are well known to the person skilled in the art and normally they may be used on the outside of a well tubular. In order to control the inflation (or deflation) of the inflatable packer section the section is normally provided with one or more valves for opening and closing of fluid communication into (or out of) the inflatable packer section.

The energy required for delivering of fluid into the inflatable packer section might be delivered by any suitable energy source, as e.g. one or more batteries contained in an energy section. In order to control the expanding of the inflatable packers the assembly might further comprises a triggering section 7. The triggering section 7 is capable of controlling the energy source and/or controlling of the valve means and, therefore, the triggering section 7 is capable of controlling the delivery of fluid into the inflatable packer section. However, as known to the skilled person, the triggering section 7 can also be capable of controlling the expansion of mechanical packers.

The triggering section 7 is thus performs a "trigger/detect function" that is capable of controlling the flow of inflation fluid to the packer. It will either release the flow of fluid by opening of valve(s) to the packer. Or it will turn on e.g. an electrical pump that will transfer the fluid into the packer. The triggering section 7 could also be adapted to control a mechanical packer.

In one embodiment of the invention the triggering section 7 is also capable of controlling the opening and/or closing of the first fluid control means. The triggering system can be activated either by a timing mechanism, RFID detection, seismic, or other kinds of sonic, optical or electric signal.

One method of use of an embodiment of the invention will now be described.

Turning to FIG. 1 there is shown a horizontal well drilled into the formation. In FIG. 1 the well has been drilled and a well tubular 12 is introduced into the well. Such a well tubular can be a casing or a liner. The outside diameter of the casing is smaller than the inside diameter of the wellbore, providing thereby an annular space 5, or annulus, between the tubular and the wellbore. The well tubular is equipped with holes/openings 3 at one or more zones. In order to stimulate the well fluid as e.g acid is discharged into the annular space through these openings configured in the wall of the tubular.

After stimulating of the well is at least two packers expanded in order to seal off a part of said annular space. However, to e.g. protect a well segment from stimulation the packers could also be expanded prior to pumping of acid. If the packers are expanded after the pumping of acid is this step normally followed by the step of closing the second fluid control means. However, the step of closing the second fluid control means could also be conducted after the stimulation but prior to the expansion of the packers.

As described above, acid stimulation of the well takes place through the second fluid control means. During this process, the first fluid control means are usually closed. It is therefore necessary to subsequently open the first fluid control means in order to allow water to run into the formation.

The closing of the second fluid control means can be accomplished by use of e.g. by "an acid-activated valve" as described below.

In injection wells, a special non-return valve will be installed with an "acid detection" mechanism or a "delayed closing" mechanism. The mechanism is that the valve will have some of its components made of a material that is acid solvable (e.g. zinc, aluminium etc.). This acid solvable material is used to protect a "hold-open" mechanism. Once the stimulation job is performed, this hold-open mechanism is dissolved, and the non-return valve will shut off flow from both directions, effectively turning into a plug.

This will facilitate that subsequent injection is directed through the opening sleeves (first fluid control means) and not through the second fluid control means (second fluid control means) inserts.

A delayed closing valve 200 can also be made with a water swellable elastomer compound 205 that slowly swells during injection of water and thereby slowly closes the valve 200, permanently. (See FIG. 2*c*.)

Figure 2A:
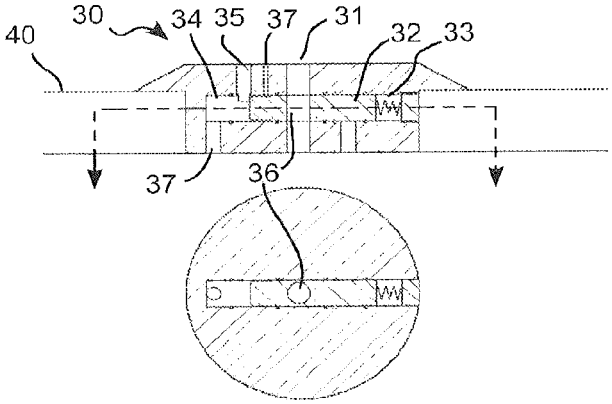
FIG. 2A shows a cross section an embodiment of a valve in its open position
Figure 2B:
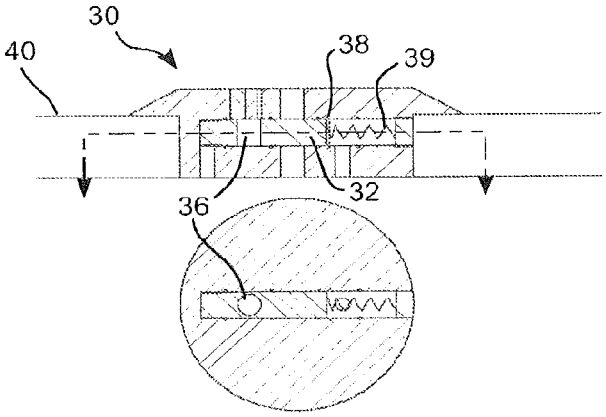
FIG. 2B shows a cross section an embodiment of a valve in its closed position
Figure 2C:
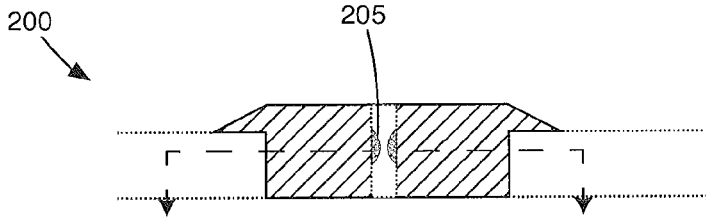
FIG. 2C shows a cross section of an embodiment of a delayed closing valve.
Figure 2D:
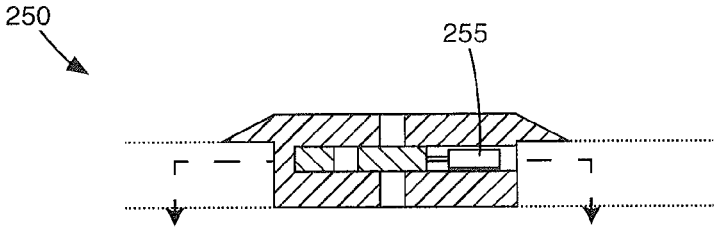
FIG. 2D shows a cross section of an embodiment of a spring and pin actuated valve.

Another embodiment of a closing valve is illustrated in FIGS. 2*a* and 2*b* showing the cross section of one embodiment of an acid activated valve 30. The acid activated valve is fastened, e.g. threaded, to a well tubular 40. The valve 30 is provided with a central flow passage 31 which leads from the inside of the well tubular to the outside of the well tubular or visa versa.

In FIG. 2 a is the valve illustrated in its open position. The valve is provided with an internal channel 31 called the central flow passage. The central flow passage 31 intersects a bore extending from one cavity 33 in the valve housing, located on one side of the central flow passage, to another cavity 34 located on the other side of the central flow passage. A gate 32, having a hole through 36, can move from the open position shown in FIG. 2 a to a closed position where a solid part of the gate 32 (shown in FIG. 2*b*) blocks the central flow passage 31.

The valve is, in the shown embodiment, operated by a spring 39 and a pin 35 but other types of actuation means known to the skilled man may be used (even electric 255 or hydraulic actuators) may be used to actuate a valve 250. (See FIG. 2*d*.) In FIG. 2 a is the valve kept in its open position by a pin 35 having its tip (or the entire pin) made of a material that is soluble in acid used for stimulation of the well (e.g. 15% Hydroclorid acid).

When the stimulation fluid is pumped through the valve, a small "weep-hole" 37 flow path ensures that the acid soluble pin 35 is emerged in a continuous flow of acid, which then weakens (or totally dissolves) the tip of the pin. While a pressure differential is present across the well tubular (i.e. fluids are being pumped through the valve), the shuttle valve will remain open due to the force acting on the left side of the gate 32 and exerting against the spring.

Once pumping stops and there is not pressure differential across the well tubular, the spring will force the gate towards the left (in the shown embodiment) until the solid part of the gate 32 (shown in FIG. 2*b*) blocks the central flow passage 31.

In that position is the valve balanced, and cannot be reopened by applying a pressure differential across the well tubular." A simple lock ring 38 can be intersected that will effectively lock the valve in the closed position.

The invention claimed is:

1. An assembly to be run with a well tubular having openings provided in a wall and for being arranged in a well bore and thereby forming a space between the tubing and a well bore surface, the assembly comprising:

a first fluid controller positioned over an opening in the well tubular, a second fluid controller positioned over a different opening in the well tubular and a set of packers for sealing off an annular space between the well tubular and the well bore surface, the set of packers being positioned such that a part of the well tubular having both the first and the second fluid controllers is located between the set of packers, wherein the first fluid controller is configured to selectively block fluid flow from the interior of the well tubular to the annular space and the second fluid controller is configured to block fluid flow from the annular space to the interior of the well tubular, the second fluid controller comprises a valve configured to automatically close, wherein the valve is configured to allow stimulation of the wellbore through the second fluid controller when the valve is in an open state, wherein the valve remains open while a stimulation pressure is at or above a threshold and the valve closes and remains closed after both a closing mechanism of the valve allows the valve to close and the stimulation pressure falls below a threshold, wherein in a closed state, the valve blocks fluid flow from the interior of the well tubular to the annular space, and from the annular space to the interior of the well tubular.

2. An assembly according to claim 1, wherein the first fluid controller comprises a closable opening being operable from the surface.

3. The assembly according to claim 2, further comprising a trigger section configured to control the first fluid controller to open.

4. The assembly according to claims 2, wherein the first fluid controller comprises a sliding sleeve door arranged on the tubular.

5. The assembly according to claim 2, wherein the second fluid controller comprises an acid activated closing mechanism.

6. The assembly according to claim 2, wherein the second fluid controller comprises a time delayed mechanism which after a certain period closes the valve, permanently.

7. An assembly according to claim 1, further comprising a trigger section configured to control the first fluid controller to open.

8. The assembly according to claims 7, wherein the first fluid controller comprises a sliding sleeve door arranged on the tubular.

9. The assembly according to claim 7, wherein the second fluid controller comprises an acid activated closing mechanism.

10. The assembly according to claim 7, wherein the second fluid controller comprises a time delayed mechanism which after a certain period closes the valve, permanently.

11. An assembly according to claim 1, wherein the first fluid controller comprises a sliding sleeve door arranged on the tubular.

12. The assembly according to claim 11, wherein the second fluid controller comprises an acid activated closing mechanism.

13. The assembly according to claim 11, wherein the second fluid controller comprises a time delayed mechanism which after a certain period closes the valve, permanently.

14. An assembly according to claim 1, wherein the second fluid controller comprises an acid activated closing mechanism.

15. An assembly according to claim 1, wherein the second fluid controller comprises a time delayed mechanism which after a certain period closes the valve, permanently.

16. A method for sealing off a part of an annulus between a well tubular and a well bore, comprising:

drilling a well into a formation;

introducing into the well a well tubular assembly that includes:

a first fluid controller positioned over an opening in the well tubular, a second fluid control section positioned over a different opening in the well tubular, and a set of packers for sealing off an annular space between the well tubular and the well bore surface, the set of packers being positioned such that a part of the well tubular having both the first and the second fluid controllers is located between the set of packers, wherein the first fluid controller is configured to selectively block fluid flow from the interior of the well tubular to the annular space and that the second fluid controller is configured to selectively block fluid flow from the annular space to the interior of the well tubular, the second fluid controller includes a valve configured to automatically close, wherein the valve is configured to allow stimulation of the wellbore through the second fluid controller while in an open state, wherein the valve remains open while a stimulation pressure is at or above a threshold and the valve closes and remains closed when the stimulation pressure falls below a threshold, wherein in a closed state, the valve blocks fluid flow from the interior of the well tubular to the annular space, and from the annular space to the interior of the well tubular pumping acid through the well tubular and further through the second fluid controller and into the formation in order to stimulate the well;

triggering of at least two assemblies in order to expand the set of packers to seal off a part of the annular space; and opening the first fluid controller and closing the second fluid controller to thereby allow water to flow from the well tubular and into the formation through first fluid controller.

17. A method according to claim 16, further comprising closing off a first fluid controller in order to shut off the fluid communication between the inner tube and the sealed off part of the annular space.

18. An assembly to be run with a well tubular having openings provided in a wall and for being arranged in a well bore and thereby forming a space between the tubing and a well bore surface, the assembly comprising:

a first fluid controller positioned over an opening in the well tubular, a second fluid controller positioned over a different opening in the well tubular and a set of packers for sealing off an annular space between the well tubular and the well bore surface, the set of packers being positioned such that a part of the well tubular having both the first and the second fluid controllers is located between the set of packers, wherein the first fluid controller is configured to selectively block fluid flow from the interior of the well tubular to the annular space and the second fluid controller is configured to block fluid flow from the annular space to the interior of the well tubular, the second fluid controller comprises a time-delayed mechanism defining a first device and a valve defining a second device separate from the first device that has an open state and a closed state, wherein the valve is configured to allow stimulation of the wellbore through the second fluid controller when the valve is in the open state, wherein the time-delayed mechanism is configured to trigger the valve to change from the open state to a permanently closed state after a certain period, wherein in a closed state, the valve blocks fluid flow from the interior of the well tubular to the annular space, and from the annular space to the interior of the well tubular.

19. An assembly to be run with a well tubular having openings provided in a wall and for being arranged in a well bore and thereby forming a space between the tubing and a well bore surface, the assembly comprising:

a first fluid controller positioned over an opening in the well tubular, a second fluid controller positioned over a different opening in the well tubular and a set of packers for sealing off an annular space between the well tubular and the well bore surface, the set of packers being positioned such that a part of the well tubular having both the first and the second fluid controllers is located between the set of packers, wherein the first fluid controller is configured to selectively block fluid flow from the interior of the well tubular to the annular space and the second fluid controller is configured to block fluid flow from the annular space to the interior of the well tubular, the second fluid controller comprises a valve configured to automatically close, wherein the valve is configured to allow stimulation of the wellbore through the second fluid controller when the valve is in an open state, wherein the second fluid controller comprises an electrically operated mechanism, which after a certain period triggers the valve to close permanently, wherein in a closed state, the valve blocks fluid flow from the interior of the well tubular to the annular space, and from the annular space to the interior of the well tubular.

* * * * *